United States Patent [19]

Akin, Jr. et al.

[11] Patent Number: 4,828,171

[45] Date of Patent: May 9, 1989

[54] HOUSING FOR A MULTI-FUNCTION APPLIANCE

[75] Inventors: Joseph A. Akin, Jr.; Thomas J. Baker, both of Birmingham, Ala.

[73] Assignee: EGN Services, Inc., Birmingham, Ala.

[21] Appl. No.: 195,196

[22] Filed: May 18, 1988

[51] Int. Cl.[4] ..... F24D 3/08

[52] U.S. Cl. ..... 237/19; 62/298; 312/236; 165/58

[58] Field of Search ..... 237/2 B, 19; 62/298, 62/259.1, DIG. 3; 165/76, 58, 59, 61, 62, 65; 312/236, 237

[56] References Cited

U.S. PATENT DOCUMENTS 4,114,065 9/1978 Horvay ..... 62/298 X

*Primary Examiner*—Henry A. Bennet

*Attorney, Agent, or Firm*—Thad G. Long

[57] ABSTRACT

A housing for a multi-function appliance designed to house, at a minimum, a natural or bottled gas-fired water heating device, an air heating device, an air cooling device, a fan section, and control components, adaptable to provide flexibility in dealing with various venting problems, arranged to facilitate servicing access from the front thereof, and constructed of a relatively small number of different panels, struts, and other parts.

34 Claims, 8 Drawing Sheets

HOUSING FOR A MULTI-FUNCTION APPLIANCE

BRIEF SUMMARY OF THE INVENTION

Natural and/or bottled gas has generally been a more efficient and more economical source of energy than electricity for performing certain functions such as water heating and air heating, at least in many areas of the United States and other countries where such gases are relatively plentiful. Thus, natural and/or bottled gas appliances for water heating and air heating have often been preferred appliances in single family homes, and other separately metered structures.

However, there have been problems in the past associated with the installation of gas-fired appliances in apartment complexes, condominiums, and other separately metered structures where there are severe space limitations. These problems largely result from the fact that gas-fired appliances, unlike electrical appliances, require venting systems, and the amount of space required for such venting systems can sometimes be a decisive factor in a builder's decision as to whether to use gas appliances or all-electric appliances in an apartment complex or other situation. Where space limitations do not feasibly permit use of gas appliances because of unacceptable space requirements for venting systems, a builder might well be forced to sacrifice the operating economies of gas-fired appliances to the space-saving economies of all-electric appliances.

To achieve optimal operating efficiencies, gas-fired water heating and air heating devices often should be used in conjunction with an electric air cooling device. Heretofore, no satisfactory appliance or combination of appliances has been developed, to our knowledge, which combines the advantageous features of gas-fired water heating and air heating devices and electric air cooling devices in a small space. Some attempts have been made, but the known attempts do not satisfactorily solve the problem for various reasons. In some instances, the appliance or appliances in combination may not be compact enough. They may not be readily serviceable after installation. They may not be feasibly adaptable to various space configurations into which they must fit. They may not lend themselves to economical assembly-line construction or fabrication.

Because of the past unavailability of a space-saving, serviceable, space adaptable and economical multi-function appliance or combination of appliances using gas-fired water heating and air heating devices in combination with electric air cooling devices, builders have in many instances opted for all-electric appliances in the interest of saving space, thereby consigning higher operating costs for the future to purchasers and occupants of certain dwelling units.

It is an object of the present invention to provide a housing for a multi-function appliance using natural or bottled gas-fired water heating and air heating devices and electric air cooling devices which: (1) can be constructed of a limited number of standard panels and struts for economical assembly-line fabrication or construction; (2) can be installed in a space comparable to comparable electric appliances: (3) can be serviced entirely from the front and within the housing confines without the necessity of providing additional clearances and/or access space exterior to the sides of said housing; and (4) can be adapted or modified in the field to permit venting out of various sides or the top and in other ways so that the housing will be useful in and compatible with various space and other configurations which may be encountered in different designs of apartments or other units.

DETAILED DESCRIPTION OF THE DRAWINGS

Figure 1:
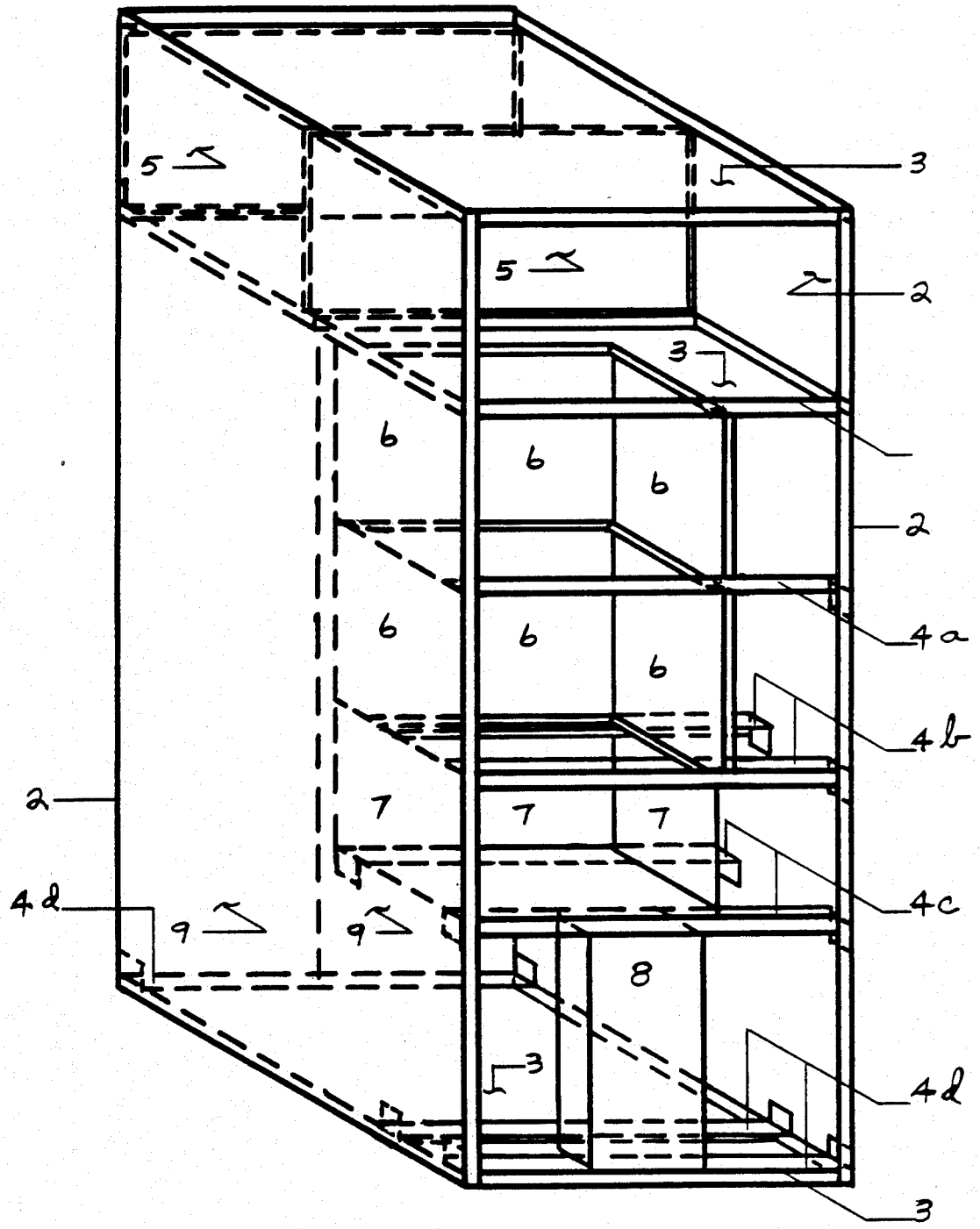
FIG. 1 is an oblique view of one of the basic configurations of the assembled housing showing an angled view of the front and left side of the housing with various compartmentalized areas thereof.

FIG. 1 shows an assembled housing 1. The two panels 2 in vertical parallel planes are visible in FIG. 1, connected by three panels 3 in horizontal parallel planes. Two of the panels 3 form the top and bottom of the housing and the remaining panel 3 separates intermediate compartments of the housing. The panels 2 and 3 have knockout sections therein so that venting can be accomplished through either side of the housing or out the top, as desired. It is contemplated that the selection of the panel or panels with the appropriate knock outs will be made at the factory or point of fabrication, in response to orders placed for left-side venting, right-side venting, backside venting, top venting, left-side access, right-side access and/or the selected configuration. However, the existence of the knockout panels will give flexibility to the installers in the field to modify the direction of venting to accommodate needs that arise or are discovered at the site of installation. This greatly simplifies inventorying of basic panels and enables assembly line fabrication using larger and more economical run quantities of the basic panels, i.e., panels 2 and 3. It is apparent that sufficient inventories of two types of panels, 2 and 3, will provide panels for five key components of the housing: both sides, the top and bottom, and an intermediate horizontal divider separating the intermediate compartment of the housing from the rest of the housing.

As is apparent from FIG. 1, two panels 6, separating vertical parts of the housing, are also identical, resulting in economies of storage and manufacture mentioned above. The same is true of the two panels 5, one of which forms the back of the top compartment in the housing, and the other of which is in a vertical plane intermediate between the front and back of the top compartment in the housing. Knockout sections in panels 5 allow for backside venting in the event that it is desirable.

Panel 7 can be a simple continuous piece of metal or other material, or be two, three or more pieces joined together to form a multi-sided configuration having a back section with a height not substantially less than 12 inches and a length not substantially less than 20 inches nor substantially more than 29 inches. The lateral depth must be no greater than the difference between the width of panel 2 and the maximum depth of the water heating device which is to be incorporated into the housing.

The space defined by panel 7 in FIG. 1 is intended to provide for the return air function. FIG. 1 also shows panel 8, having a configuration of three sides or any other shape that will isolate, from the rest of the housing, control components for the air cooling cycle, air heating cycle and air distribution cycle.

In a preferred embodiment, the top compartment houses venting components from the water heating device in the space between the two panels 5 in the rear of the top compartment. The remaining (front) space in the top compartment is an insulated cavity which houses a multi-position supply air fan assembly, fan motor, hydronic pumping means and an electrical junction box with disconnecting means.

Cooling and heating coils are set into each of two spaces within panels 6 in a preferred embodiment. These coils are supported by panels 6 which, in turn, depend from panel 3 and/or rest on struts such as those shown in positions 4 in FIG. 1, particularly 4*a*, 4*b* and 4*c*, and pivoted at one side or the other so as to swing or slide forward for service work.

The space below panel 7 in FIG. 1 on a preferred embodiment is intended to house the air cooling compressor and the panel 8 which encompasses the control components for the cooling cycle, space heating cycle and air distribution cycle.

On certain configurations, a preferred embodiment contemplates that a gas-fired water heating device will be situated in the rear of said housing, extending from the bottom panel 3 as high up as the intermediate panel 3, i.e., behind the coils, return air space, compressor and controls, and beneath the venting space and supply air fan assembly (which are in the top compartment).

FIG. 1 also shows two panels 9 extending vertically from the bottom panel 3 as high up as the underside surface of intermediate panel 3 and serving as rear closure for the basic housing and as separation/access panels between the above-described water heating device space and the back-mated condenser fan sections on certain configurations.

It will be observed that on the right side of the housing from bottom panel 3 to any intermediate panel 3, there is space which, to varying extents, is empty. The purpose of this space is to allow servicing of the appliances as necessary. Certain of the appliances and/or components are easily accessible from the front, such as the coils, compressor, valves and controls. The coils and/or encompassing panels 6 are especially easy to service because they are designed to swing forward around a pivot point and/or are slidably removeable from the front. However, the water heating device and venting system at the rear can be serviced through the said access space at the right of the housing. Furthermore, in some configurations there will be attached to the back of the housing to extend outdoors through a building wall a condenser and fan and/or other appliances or components of appliances. In such situations, it will sometimes be difficult or inconvenient or expensive to service the exterior back-mated components from the outside. For such cases, access through the front of the housing in order to reach the back-mated components for servicing is important. The access areas along the right side of the housing, together with the removability of the coils by swinging them forward around their pivot points and/or moving coils to a slidably more convenient position make it possible to service such back-mated components through the front of the housing, and thus from the inside of the building rather than the outside. Of course the coils and other appliances could be shifted to the right so that the access space is on the left. It obviously is immaterial to this invention whether the access space is at the right or at the left.

Figure 2:
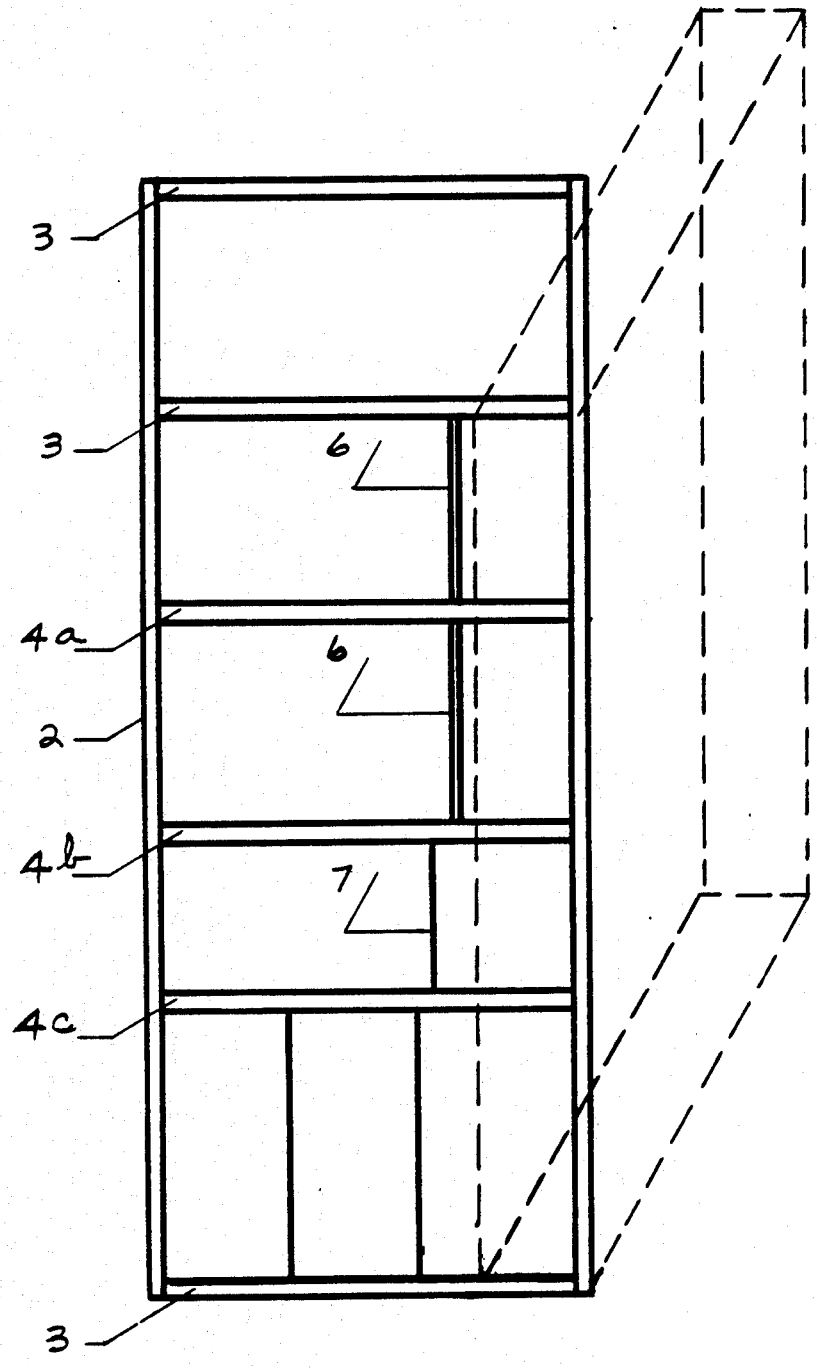
FIG. 2 is a straight frontal view showing one of the basic configurations of the assembled housing and showing various compartmentalized areas thereof, with an access area on the right side below the top compartment being highlighted by projecting same slightly laterally.

FIG. 2 is a straight-on frontal view of the housing 1. All numbers refer to the same panels and items as discussed in connection with FIG. 1, and the discussion in that regard need not be repeated here. The projected lines forming the said access space are merely a highlighted illustration of the access area. Allowing such an access area is very important to the practical feasibility of this invention, because it is as important that the appliances housed therein be readily accessible for service work as it is to fit the necessary appliances into a particular space configuration at the time of installation.

Figure 3:
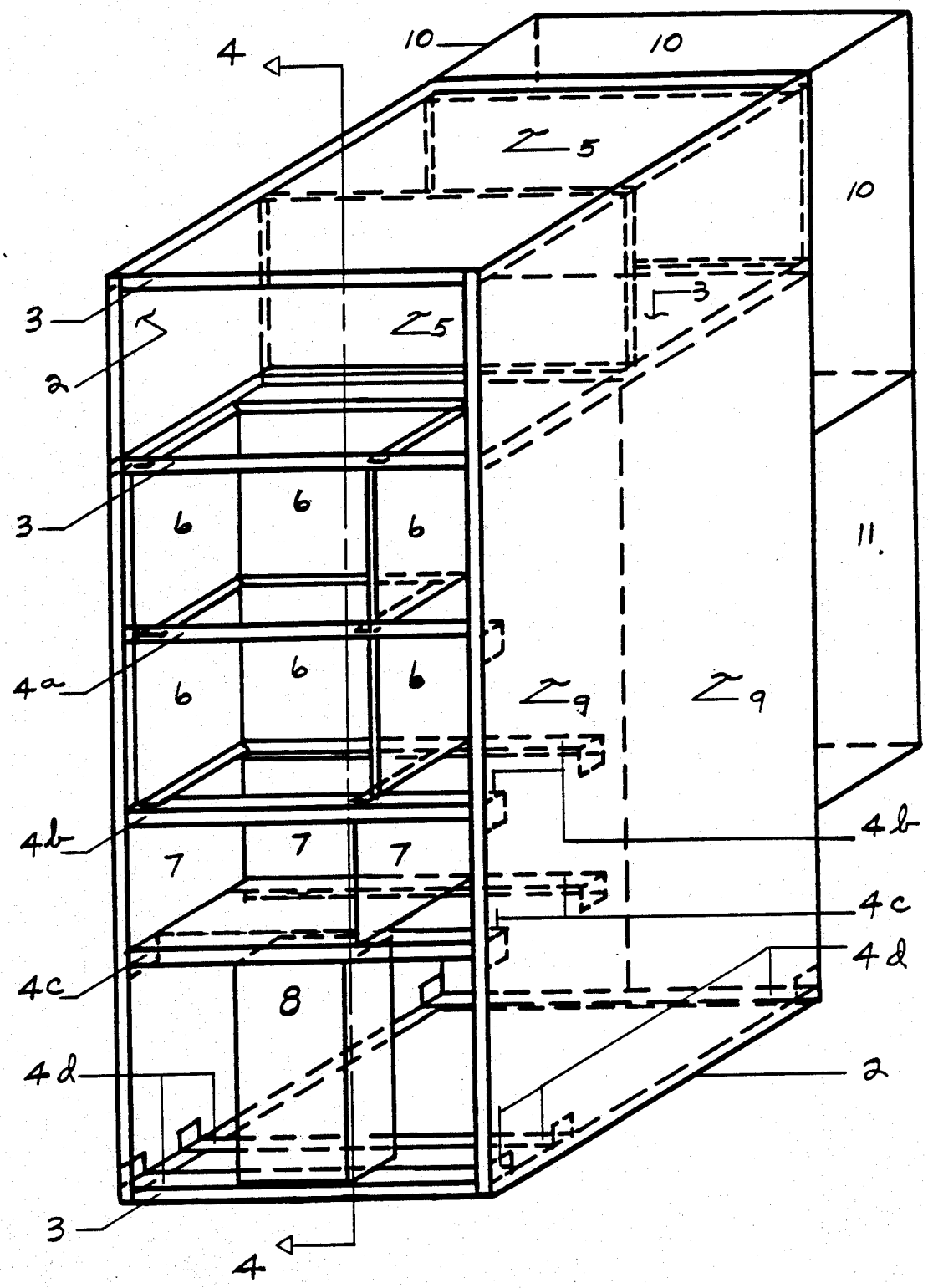
FIG. 3 is an oblique view of one of the basic configurations of the assembled housing showing an angled view of the front and right side of the housing and also showing at the back of the housing a protruding compartment for certain fan and coil components of the integrated appliance to be filled within the housing.

FIG. 3 is an angled front and right side view of the housing 1. All numbers refer to the same panels and items as discussed in connection with FIG. 1 and the discussion in that regard need not be repeated here. However, in this case, there has been included as an attachment to the back of the basic housing, an assembly of panels 10 which encompasses a condenser coil assembly and an assembly of panels 11 which encompasses a condenser fan, condenser fan motor and fan mounting means, in a preferred embodiment. Panels 10 and 11 assembled can be attached at the rear of the basic housing as shown in FIG. 3 or can be attached to the lower section of the left or right lateral panel 2. Furthermore, assembled panels 10 and 11, or either of them, can be totally separated from the basic housing 1 shown in FIG. 1 and FIG. 2 and their components can be mounted and/or operated remotely. They must in any event be facing outdoors. Since space limitations which dictate the necessity of a compact, versatile and readily serviceable housing are usually less important for the components to be placed on the outside of a building, such as panels 10 and 11, it follows that the configurations of panels 10 and 11 will not normally be of critical importance as long as they are of sizes sufficient to house components compatible with the basic interior housing 1 and are aesthetically acceptable and are reasonably durable. Accordingly, the particular configuration and size of panels 10 and 11 are not material to this invention, at least within very broad limits.

Figure 4:
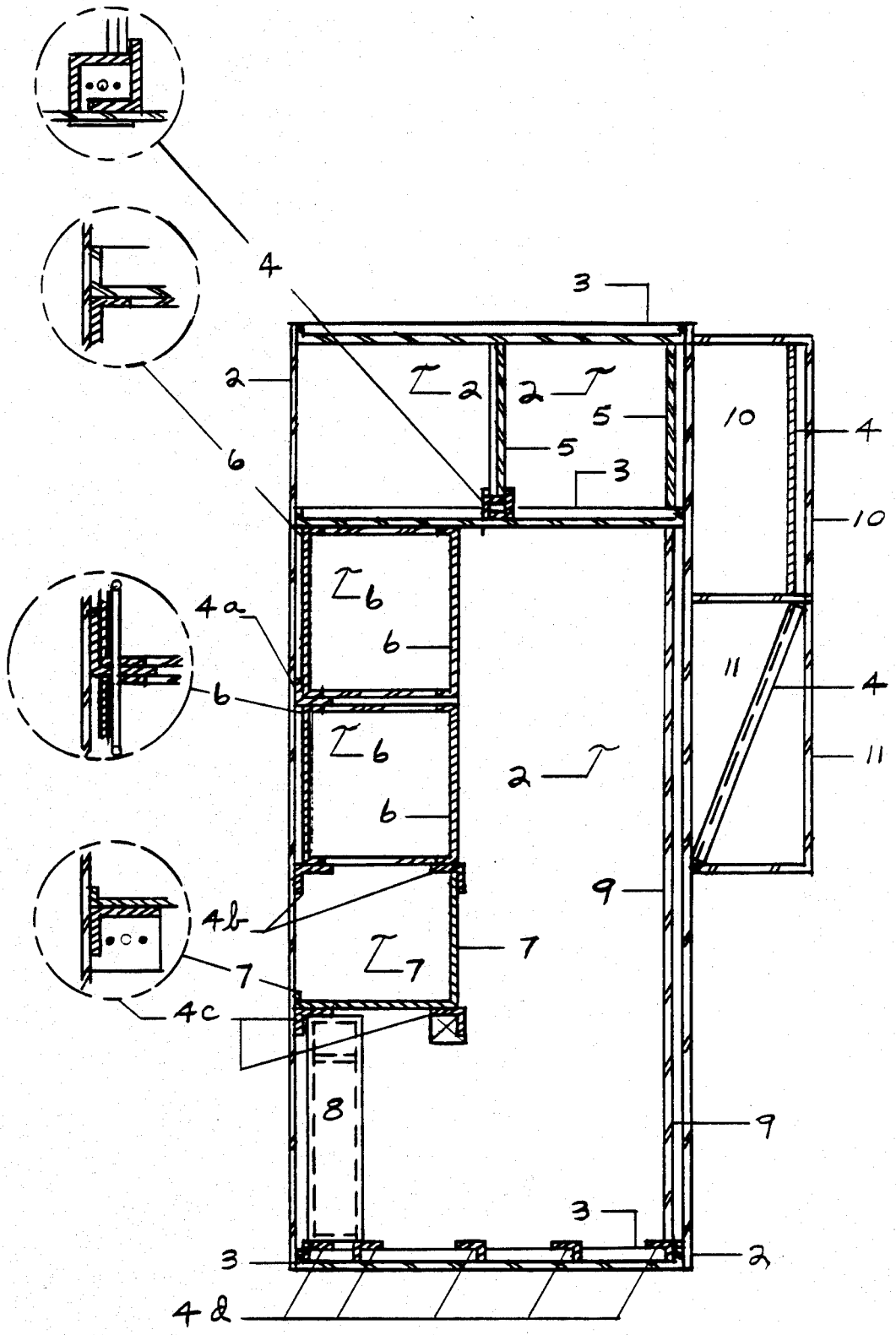
FIG. 4 is a sectional view looking into the right lateral side of the assembled housing as shown in FIG. 3.

FIG. 4 is a sectional view of FIG. 3 showing panels 10 and 11 attached to the back of housing 1. It should be emphasized that this is simply one of many arrangements of panels 10 and 11, which need not even be in physical contact with housing 1, but merely illustrates one possible configuration. FIG. 4 is also a right lateral side sectional view of FIG. 3.

Certain struts 4, i.e. 4*a*, 4*b*, 4*c* and 4*d* are shown in FIG. 1, 2, 3 and 4. However, struts can be used at various places in housing 1 to give additional strength or to serve as a means for attachement of various panels or components. The number of struts to be used depends on the strength requirements for the housing and on the selected configuration.

In the preferred embodiment, the struts are all of substantially uniform dimensions and have substantially uniform characteristics. The struts can be mounted with any of numerous well-known mounting means, such as an L-shaped mounting means attached thereto with fasteners or other means of rigid attachment.

Figure 5:
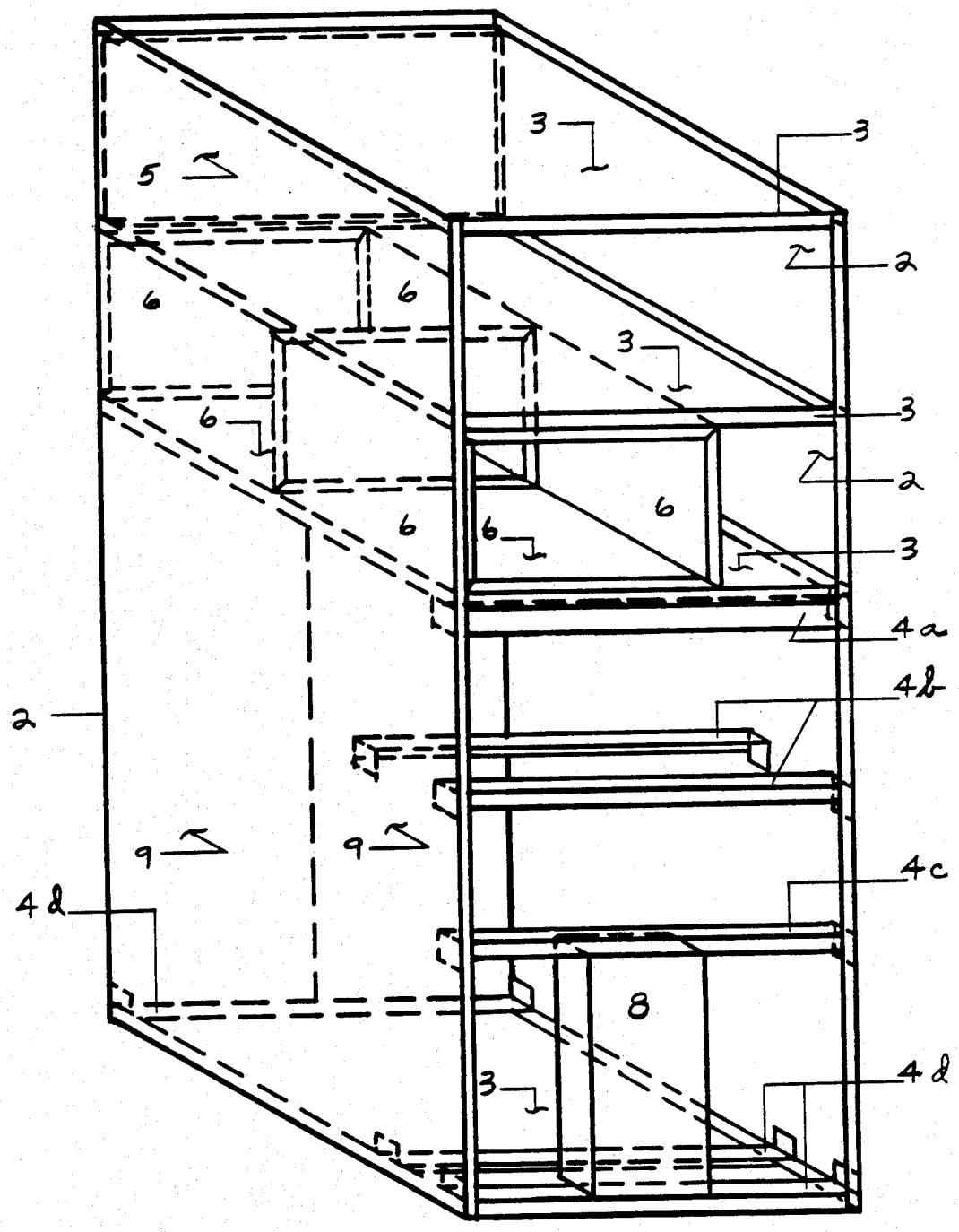
FIG. 5 is an oblique view of one of the basic configurations of the assembled housing showing an angled view of the front and left side of the housing with various compartmentalized areas thereof.

FIG. 5 shows an assembled housing 1. The two panels 2 in vertical parallel planes are visible in FIG. 5, connected by three or more panels 3 in horizontal parallel planes. Two of the panels 3 form the top and bottom of the housing and the remaining panels 3 separate intermediate compartments of the housing. The panels 2 and 3 have knockout sections therein so that venting can be accomplished through either side of the housing or out the back, as desired. It is contemplated that the selection of the panel or panels with the appropriate knock outs will be made at the factory or point of fabrication, in response to orders placed for left-side venting, right-side venting, backside venting, left-side access, right-side access and/or the selected configuration. However, the existence of the knockout panels will give flexibility to the installers in the field to modify the direction of venting to accommodate needs that arise or are discovered at the site of installation. This greatly simplifies inventorying of basic panels and enables assembly line fabrication using larger and more economical run quantities of the basic panels, i.e., panels 2 and 3. It is apparent that sufficient inventories of two types of panels, 2 and 3, will provide panels for six key components of the housing; both sides, the top and bottom, and intermediate horizontal dividers separating the intermediate compartments of the housing from the rest of the housing.

As is apparent from FIG. 5, two panels 6, separating lateral parts of the housing in certain other configurations are also identical resulting in economies of storage and manufacture mentioned above.

As is apparent from FIG. 5, one panel 5 forms the back of the top compartment in said housing 1.

FIG. 5 also shows panel 8, having a configuration of three sides or any other shape that will isolate from the rest of the housing, control components for the air cooling cycle, air heating cycle and air distribution cycle.

In a preferred embodiment, the rear section of the top compartment houses an insulated plenum cavity in the space behind the fan assembly. The remaining (front) space in the top compartment forms an insulated cavity which houses a multi-position supply air fan assembly, fan motor, hydronic pumping means and an electrical junction box with disconnecting means.

Air cooling and heating coils are set into each of two spaces within panels 6 in a preferred embodiment. These coils are supported by panels 6 which in turn rest on panel 3 and which can be slid toward the front of said housing for service work.

The space below lower intermediate panel 3 in FIG. 5 on a preferred embodiment is intended to house the air cooling compressor and the panel 8 which encompasses the control components for the cooling cycle, space heating cycle and air distribution cycle.

On certain configurations, a preferred embodiment contemplates that a gas-fired water heating device will be situated in the rear of the housing, extending from the bottom panel 3 as high up as the lower face of one of the intermediate panels 3, i.e., below the coils, insulated plenum space and supply air fan assembly and behind the return air opening, filter rack, compressor and controls.

FIG. 5 also shows two panels 9 extending vertically from the bottom panel 3 as high up as the lower surface of upper intermediate panel 3 and serving as rear closure for the basic housing 1 and as separation/access panels between the above-described water heating device space and the back-mated condenser and fan sections on certain configurations.

It will be observed that on the right side of the housing from bottom panel 3 to any intermedite panel 3, there is open space which, to varying extents, is empty. The purpose of this space is to allow servicing of the appliances as necessary. Certain of the appliances and/or components are easily accessible from the front, such as the coils, compressor, valves and controls. The coils and/or encompassing panels 6 are especially easy to service because they are designed to be slidably removeable from the front. In a preferred embodiment, the water heating device and venting system can be serviced through the access space at the right of the housing. Furthermore, in some configurations there will be attached to the back of the housing to extend outdoors through a building wall a condenser and fan and/or other appliances or components of appliances. In such situations, it will sometimes be difficult, inconvenient or expensive to service the exterior back-mated components from the outside. For such cases, access through the front of the housing in order to reach the back-mated components for servicing is important. The access space along the right side of the housing, together with the removability of the coils by sliding them forward to a more convenient position make it possible to service such back-mated components through the front of the housing, and thus from the inside of the building rather than the outside. Of course the coils and other appliances could be shifted to the right so that the access space is on the left. It obviously is immaterial to this invention whether the access space is at the right or at the left.

Figure 6:
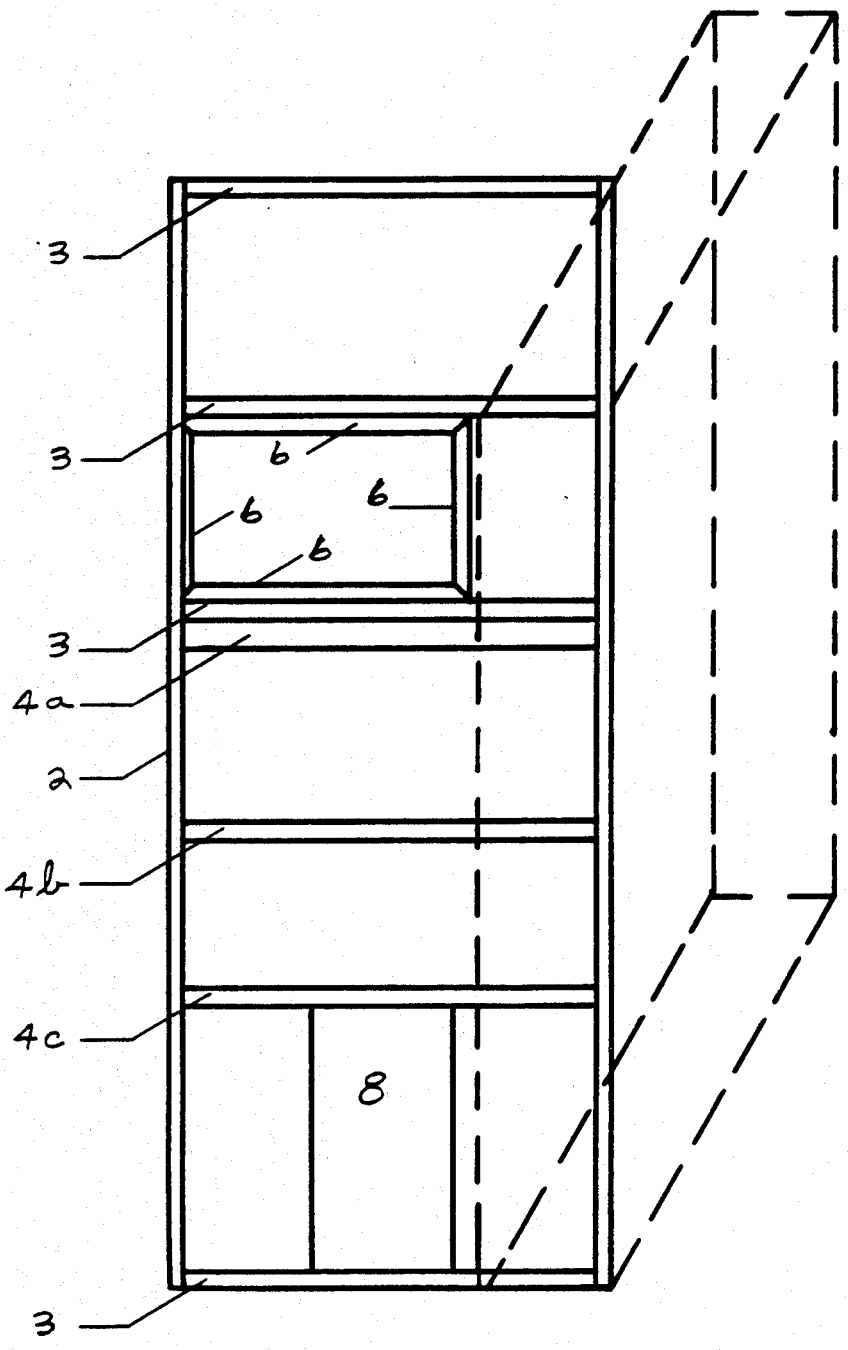
FIG. 6 is a straight frontal view of one of the basic configurations of the assembled housing and showing various compartmentalized areas thereof, with an access area on the right side below the top compartment being highlighted by projecting same slightly laterally.

FIG. 6 is a straight-on frontal view of the housing 1. All numbers refer to the same panels and items as discussed in connection with FIG. 5, and the discussion in that regard need not be repeated here. The projected lines forming the said access space are merely a highlighted illustration of the access area. Allowing such an access area is very important to the practical feasibility of this invention, because it is as important that the appliances housed therein be readily accessible for service work as it is to fit the necessary appliances into a particular space configuration at the time of installation.

Figure 7:
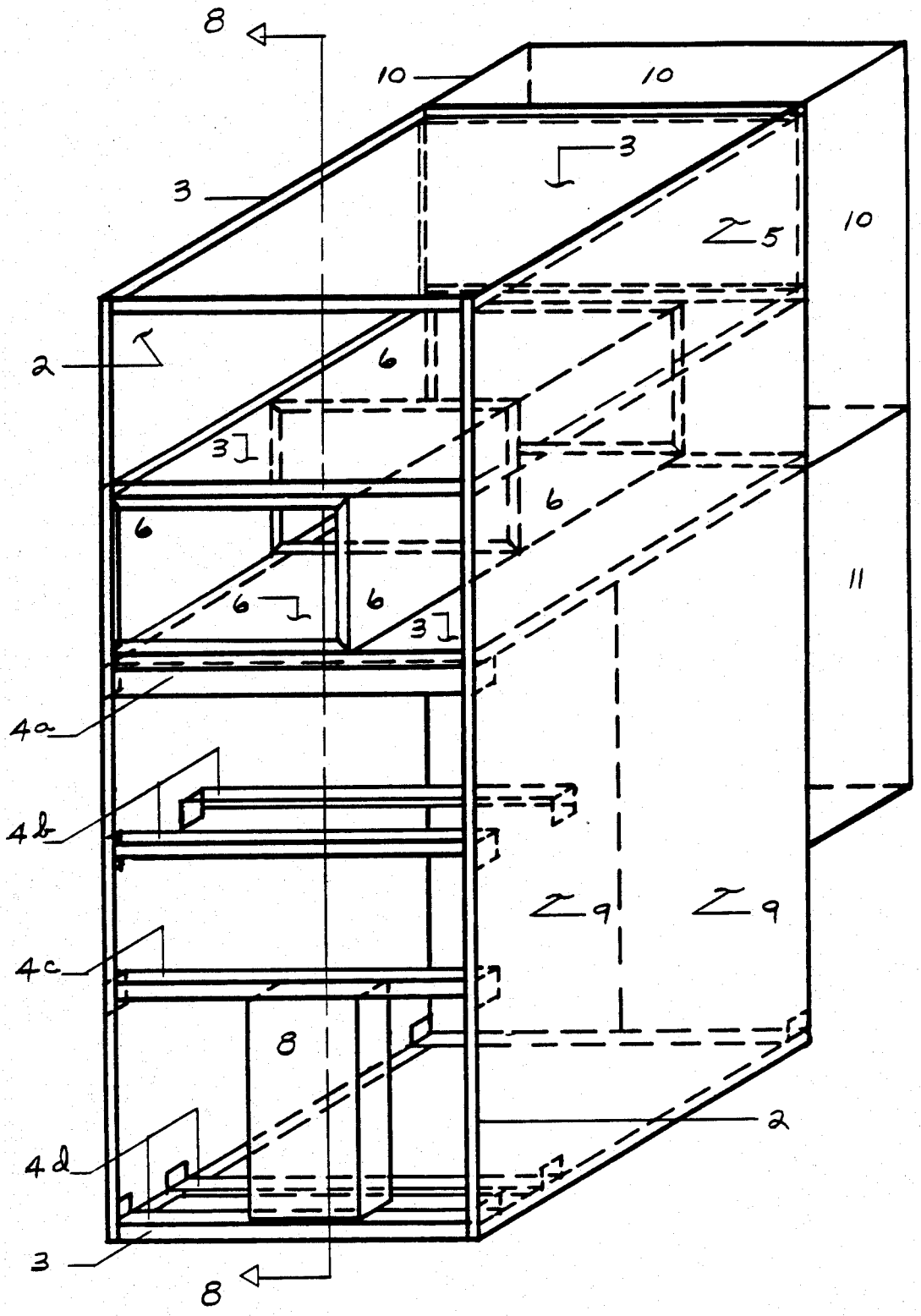
FIG. 7 is an oblique view of one of the basic configurations of the assembled housing showing an angled view of the front of the housing and also showing at the back of the housing a protruding compartment for certain fan and coil components of the integrated appliance to be filled within the housing.

FIG. 7 is a front and right side view of the housing 1. All numbers refer to the same panels and items as discussed in connection with FIG. 5 and the discussion in that regard need not be repeated here. However, in this case, there has been included as an attachment to the back of the basic housing an assembly of panels 10 which encompasses a condenser coil assembly and an assembly of panels 11 which encompasses a condenser fan, condenser fan motor and fan mounting means, in a preferred embodiment. Assemblies of panels 10 and 11 can be attached at the rear of the basic housing as shown in FIG. 7 or can be attached to the lower section of the left or right lateral panel 2. Furthermore, assembled panels 10 and 11, or either of them, can be totally separated from the basic housing 1 shown in FIG. 5 and FIG. 6 and their components can be mounted and/or operated remotely. They must in any event be facing outdoors. Since space limitations which dictate the necessity of a compact, versatile and readily serviceable housing are usually less important for the components to be placed on the outside of a building, such as panels 10 and 11, it follows that the configurations of panels 10 and 11 will not normally be of critical importance as long as they are of sizes sufficient to house components compatible with the basic interior housing 1 and are aesthetically acceptable and are reasonably durable. Accordingly, the particular configuration and size of panels 10 and 11 are not material to this invention, at least within very broad limits.

Figure 8:
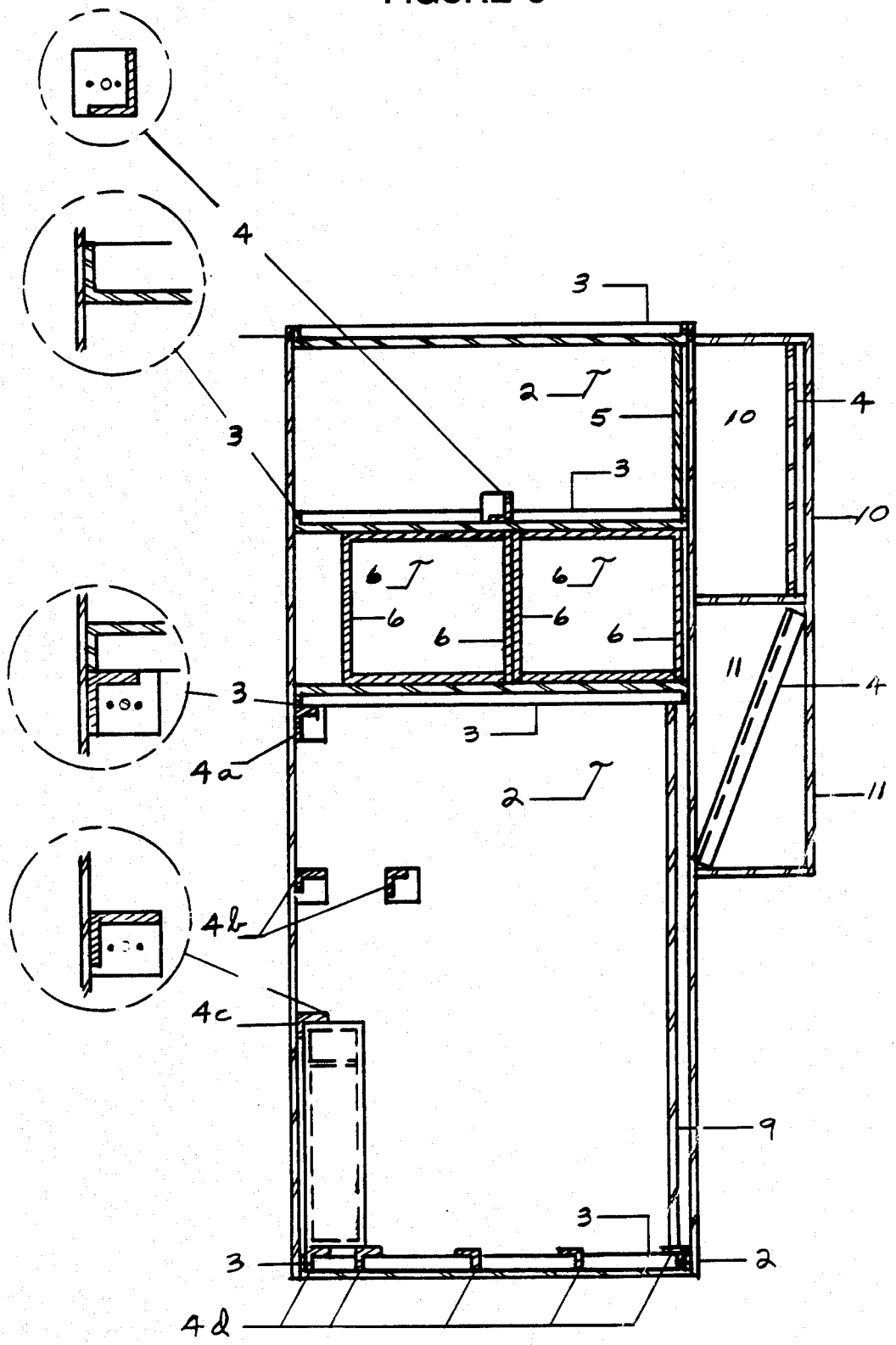
FIG. 8 is a sectional view looking into the right lateral side of the assembled housing as shown in FIG. 7.

FIG. 8 is a sectional view of FIG. 7 showing panels 10 and 11 attached to the back of housing 1. It should be emphasized that this is simply one of many arrangements of panels 10 and 11, which need not even be in physical contact with housing 1, but merely illustrates one possible configuration. FIG. 8 is also a right lateral side sectional view of FIG. 7.

Certain struts 4, i.e., 4*a*, 4*b*, 4*c* and 4*d* are shown in FIGS. 5, 6, 7 and 8. However, struts can be used at various places in housing 1 to give additional strength or to serve as a means for attachment of various panels or components. The number of struts to be used depends on the strength requirements for the housing and on the selected configuration.

In a preferred embodiment, the struts are all of substantially uniform dimensions and have substantially uniform characteristics. The struts can be mounted with any of numerous well-known mounting means, such as an L-shaped mounting means attached thereto with fasteners or other means of rigid attachment.

What is claimed is:

1. A housing for multiple-function appliances to contain, at a minimum, a natural or bottled gas-fired water heating device, an air heating device, an air cooling device, a fan section, and control components comprising:

(A) two panels having substantially rectangular dimensions, as between themselves, and having knock-out sections therein;

(B) three panels having substantially uniform rectangular dimensions, as among themselves, and knock-out sections therein, the specific minimum dimensions of which are determined by the size of said appliances to be encompassed within said housing;

(C) two panels having substantially uniform substantially rectangular dimensions, as between themselves, and knock-out sections therein, two sides of each of which panels have substantially the same length as two sides of the said panels referred to in (B) above, and with the minimum length of the second sides of the panels referred to in this item (C) being determined by the height of the fan section of the appliances to be encompassed within said housing;

(D) one or more panels which, assembled, form rectangular dimensions, two sides of which, assembled, substantially equal the difference between the longer side of the panel referred to in item (A) above and the length of the second side of the panels referred to in item (C) above, and the second side, assembled, equal to the shorter side of the panels referred to in (B) above:

(E) two panels, each having a configuration of angles or curves or combinations thereof so as wholly or partially to encompass heating and cooling coils, respectively, and having dimensions from one curved or angled end to a second curved or angled end at least seven inches less than the shorter length of the panels described in item (B) above, and with minimum height determined by the height of the heating or cooling coils, respectively to be encompassed therein;

(F) one or more panels having a configuration of angles or curves or combinations thereof having dimensions from one curved or angled end to a second curved or angled end not less than twenty inches nor more than twenty-nine inches, having a height not less than twelve inches, and having a depth not less than ten inches and not more than the difference between the shorter side of the panel described in item (A) above and the maximum depth of a water heating device to be encompassed in said housing;

(G) one or more panels having a configuration of angles or curves or a combination thereof having minimum dimensions necessary to isolate, from the rest of the housing, control components for the cooling cycle, space heating cycle and air distribution cycle of said appliances;

(H) struts of one or more lengths substantially equal, respectively, to the inside dimensions of said housing;

(I) mounting means for said struts;

(J) panels configured to enclose circumferentially or on three or more enclosing sides a condenser fan, condenser fan motor, and fan mounting means components of said air cooling device; and (K) panels configured to enclose circumferentially or on three or more enclosing sides a condenser coil assembly part of said air cooling device;

wherein:

(i) the panels referred to in item (A) above are arranged in vertical parallel planes directly opposite each other, spaced apart a distance defined by the shorter length of the panels referred to in item (B) above;

(ii) the panels referred to in item (B) above are arranged in three substantially parallel horizontal planes within the space defined by the panels set up as described in (i) above, two of said (B) panels forming the top and bottom of the said housing, and the third of said (B) panels separating the fan section of said housing in the top section of said housing from the remainder of said housing and being placed a sufficient distance from the top to accommodate the said fan section;

(iii) the panels referred to in item (D) above are arranged to form part of the back of said housing beginning with the base thereof and extending upward to the underside surface of panel (B) as described in (ii) above;

(iv) the panels referred to in item (C) above are arranged so that one of them forms the back of the top section of the said housing and the other is arranged opposite and parallel thereto separating the vent section from the fan section in the top section of said housing;

(v) the panels referred to in item (E) above are arranged vertically, generally parallel to the side panels of the housing, one over the other at the front of the said housing, beneath the fan section immediately adjacent to one or the other of the side panels arranged as described in (i) above;

(vi) in certain configurations the panel referred to in item (F) above arranged vertically at the front of said housing beneath the panels described in (v) above and no nearer than nine inches to the lateral side panel adjacent the service access area;

(vii) the panel referred to in item (G) above arranged vertically at the front of said housing beneath the panel described in (vi) above, and at the bottom level of said housing, immediately next to the compressor for the air cooling device, which in turn is adjacent to the lateral side panel nearest to the said water heating device;

(viii) the configured panels referred to in items (J) and (K), respectively, may be arranged at the back of the portion of the said housing formed by steps (i) through (vii) above, inclusive, or at either side of said housing, or at a location remote from said housing formed by steps (i) through (vii) above, inclusive;

(ix) the various panels referred to are attached together in the relationships set out in steps (i) through (vii) above, inclusive, with attaching means; and (x) said struts are used to the extent, if any, desired to give additional stability and rigidity to said housing, by attachment between panels by said mounting means.

2. A housing for an appliance as described in claim 1 above, wherein all struts are substantially of uniform dimensions substantially equal to the length of the shorter sides of panels (B) of claim 1.

3. A housing as described in claim 1 where the air heating device is a hydronic fan coil.

4. A housing as described in claim 1 wherein the intermediate panel referred to in step (ii) in claim 1 separates the water heating device's venting system from the supply air fan, modular coil enclosures and return air opening of the air cooling and air heating devices.

5. A housing as described in claim 1 wherein the fan discharge of the air cooling and air heating devices can be adjusted for front discharge or top discharge by removing the knock-out section of the appropriate panel and connecting a discharge means to the space defined by the section so removed.

6. A housing as described in claim 1 wherein all components of the appliances within or associated with said housing are accessible and serviceable through the front of said housing.

7. A housing as described in claim 1 wherein condenser fans of the cooling device are wholly or partially rotatable so as to permit movement from a first position within said housing to a serviceably more convenient second position.

8. A housing as described in claim 1 wherein a control panel for electrical components of said appliances is slidably positioned on a track to permit movement from a first position to a serviceably more convenient second position.

9. A housing as described in claim 8 wherein said track is made of two of the said struts.

10. A housing as described in claim 6 wherein condenser fans of the air cooling device are wholly or partially rotatable so as to permit movement of said condenser fans from a first position within said housing to a serviceably more convenient second position and wherein a control panel for electrical components of said appliances is slidably positioned on a track to permit movement from a first position to a serviceably more convenient second position.

11. A housing as described in claim 10 wherein said track is made of two of said struts.

12. A housing as described in claim 1 wherein the water heating device can be positioned substantially adjacent to any interior lateral side of said housing.

13. A housing as described in claim 7 wherein the water heater can be positioned substantially adjacent to any interior lateral side of said housing.

14. A housing as described in claim 9 wherein the water heating device can be positioned substantially adjacent to any interior lateral side of said housing.

15. A housing as described in claim 10 wherein the water heater can be positioned substantially adjacent to any interior lateral side of said housing.

16. A housing as described in claim 11 wherein the water heater can be positioned substantially adjacent to any interior lateral side of said housing.

17. A housing as described in claim 1 wherein the heating and cooling coil section of the air heating and air cooling devices located in the space between panels described in (E) of claim 1 and the distal side panel as described in (A) of claim 1, as assembled in accordance with claim 1, are attached for support suspendably to one or more of said struts extending horizontally from attaching points on side panels of said housing.

18. A housing as described in claim 1 wherein the condensing section of the air cooling device is separable from said housing and remotely connectable by refrigerant lines to those portions of the said air cooling device within said housing.

19. A housing for multiple-function appliances to contain, at a minimum, a natural or bottled gas-fired water heating device, an air heating device, an air cooling device, a fan section and control components, comprising:

(A) two panels having substantially uniform rectangular dimensions, as between themselves, and having knock-out sections, therein;

(B) three or more panels having substantially uniform rectangular dimensions, as among themselves, and knock-out sections therein, the specific minimum dimensions of which are determined by the size of said appliances to be encompassed within said housing;

(C) one panel having substantially rectangular dimensions, and knock-out sections therein, two sides of which panel has substantially the same length as two sides of the said panels referred to in (B) above, and with the minimum length of the second side of the panel referred to in this item (C) being determined by the height of the fan section of the appliances to be encompassed within said housing;

(D) one or more panels which, assembled, form rectangular dimensions, two sides of which assembled are substantially equal to the difference between the longer side of the panel referred to in item (A) above and the length of the second side of the panel referred to in item (C) above, and the second side, assembled, equal to the shorter side of the panels referred to in (B) above;

(E) two panels, each having a configuration of angles or curves or combinations thereof so as wholly or partially to encompass heating and cooling coils, respectively, and having dimensions from one curved or angled end to a second curved or angled end at least seven inches less than the shorter length of the panels described in item (B) above, and with minimum height determined by the height of the heating or cooling coils, respectively, to be encompassed therein;

(F) one or more panels having a configuration of angles or curves or a combination thereof having minimum dimensions necessary to isolate, from the rest of the housing, control components for the cooling cycle, space heating cycle and air distribution cycle of said appliances;

(G) struts of one or more lengths substantially equal, respectively, to the inside dimensions of said housing;

(H) mounting means for said struts;

(I) panels configured to enclose circumferentially or on three or more enclosing sides a condenser fan, condenser fan motor, and fan mounting means components of said air cooling device; and (J) panels configured to enclose circumferentially or on three or more enclosing sides a condenser coil assembly part of the said air cooling device;

wherein:

(i) the panels referred to in item (A) above are arranged in vertical parallel planes directly opposite each other, spaced apart a distance defined by the shorter length of the panels referred to in item (B) above;

(ii) the panels referred to in item (B) above are arranged in three or more substantially parallel horizontal planes within the space defined by the panels set up as described in (i) above, two of said (B) panels forming the top and bottom of the said housing, and the third of said (B) panels beginning a sufficient distance from the top panel of said housing to accommodate thereabove the fan assembly and its return air section of the said air heating and air cooling devices and the fourth of said (B) panels spaced a sufficient distance below the said third of said (B) panels to accommodate therebetween the coils sections of said devices;

(iii) the panels referred to in item (D) above are arranged to form part of the back of said housing beginning with the base thereof and extending upward to the underside surface of the third panel (B) as described in (ii) above;

(iv) the panel referred to in item (C) above is arranged so that it forms the back of the return air section in the top section of said housing;

(v) the panels referred to in item (E) above are arranged horizontally, one behind the other, immediately adjacent to one or the other of the lateral side panels as described in (i) above, and within the space between the third and fourth of said (B) panels;

(vi) the panel referred to in item (F) above arranged vertically at the front of said housing, supported by the bottom level of said housing and positioned immediately next to the compressor for the air cooling device, which in turn is adjacent to the lateral side panel nearest to the said water heating device;

(vii) the configured panels referred to in items (I) and (J), respectively, may be arranged at the back of the portion of the said housing formed by steps (i) through (vi) above, inclusive, or at either side of said housing, or at a location remote from said housing formed by steps (i) through (vi) above, inclusive;

(viii) the various panels referred to are attached together in the relationships set out in steps (i) through (vi) above, inclusive, with attaching means; and (ix) said struts are used to the extent, if any, desired to give additional stability and rigidity to said housing, by attachment between panels by said mounting means.

20. A housing for an appliance as described in claim 19 above, wherein all struts are substantially of uniform dimensions substantially equal to the length of the shorter sides of panels (B) of claim 19.

21. A housing as described in claim 19 wherein the lower intermediate (fourth) panel (B) referred to in step (ii) in claim 19 separates said water heating device's venting system from the supply air fan, modular coil boxes and return air opening of the air cooling and air heating devices.

22. A housing as described in claim 19 wherein the fan discharge of the air cooling and air heating devices can be adjusted for front discharge or top discharge by removing the proper knock-out section of the appropriate panel and connecting a discharge means to the space defined by the section so removed.

23. A housing as described in claim 19 wherein all components of the appliances within or associated with said housing are accessible and serviceable through the front of said housing.

24. A housing as described in claim 19 wherein the condenser fan or fans of the air cooling device are wholly or partially rotatable so as to permit movement from a first position within said housing to a serviceably more convenient second position.

25. A housing as described in claim 19 wherein a control panel for electrical components of said appliances is slidably and/or rotatably positioned on a track to permit movement from a first position to a serviceably more convenient second position.

26. A housing as described in claim 26 wherein said track is made of two of the said struts.

27. A housing as described in claim 24 wherein the condenser fan or fans of the air cooling device are wholly or partially rotatable so as to permit movement of said condenser fans from a first position within said housing to a serviceably more convenient second position and wherein a control panel for electric components of said appliances is slidably or rotatably positioned on a track to permit movement from a first position to a serviceably more convenient second position.

28. A housing as described in claim 28 wherein said track is made of two of said struts.

29. A housing as described in claim 19 wherein the water heating device can be positioned substantially adjacent to any interior lateral side of said housing.

30. A housing as described in claim 25 wherein the water heater can be positioned substantially adjacent to any interior lateral side of said housing.

31. A housing as described in claim 27 wherein the water heating device can be positioned substantially adjacent to any interior lateral side of said housing.

32. A housing as described in claim 28 wherein the water heater can be positioned substantially adjacent to any interior lateral side of said housing.

33. A housing as described in claim 29 wherein the water heater can be positioned substantially adjacent to any interior lateral side of said housing.

34. A housing as described in claim 19 wherein the condensing section of the air cooling device is separable from said housing and remotely connectable by refrigerant lines to those portions of the said air cooling device within said housing.

* * * * *